United States Patent [19]

Collins, Jr. et al.

[11] Patent Number: 4,846,224

[45] Date of Patent: Jul. 11, 1989

[54] VORTEX GENERATOR FOR FLOW CONTROL

[75] Inventors: Earl R. Collins, Jr., La Canada; Wilbur J. Marner, Arcadia; Naresh K. Rohatgi, Pomona, all of Calif.

[73] Assignee: California Institute of Technology, Pasadena, Calif.

[21] Appl. No.: 228,065

[22] Filed: Aug. 4, 1988

[51] Int. Cl.[4] ..... F15C 1/16

[52] U.S. Cl. ..... 137/810; 137/813

[58] Field of Search ..... 137/810, 812, 813

[56] References Cited

U.S. PATENT DOCUMENTS

| | | | |
|---|---|---|---|
| 3,511,257 | 5/1970 | Chow | 137/813 |
| 3,545,468 | 12/1970 | Freeman | 137/810 |
| 4,542,775 | 9/1985 | Beck | 137/812 |

FOREIGN PATENT DOCUMENTS

| | | | |
|---|---|---|---|
| 796475 | 1/1981 | U.S.S.R. | 137/812 |

*Primary Examiner*—A. Michael Chambers

*Attorney, Agent, or Firm*—Frelich Hornbaker Rosen & Fernandez

[57] ABSTRACT

Fluidics flow control of a multiphase supply using a cylindrical chamber is achieved by introducing the supply flow radially into the chamber. The supply flow exits through a port in the center at the chamber. A control fluid is then introduced tangentially about 90° upstream from the supply port. A second control fluid port may be added about 90° upstream from the first control fluid port, but preferably two sets of supply and control ports are added with like ports diametrically opposite each other. The control fluid flows against the circular wall of the control chamber, which introduces a vortex in the flow of the supply flow that decays into a spiral path to the exit port in the center of the chamber. The control flow rate may thus be used to control the spiral path, and therefore the supply flow rate through the exit port.

8 Claims, 5 Drawing Sheets

$$a_1 P_s - a_2 P_0 - \tfrac{1}{2}\rho V_\theta^2 (\pi DH) = 0$$

Force Balance Conditon
At Cutoff

VORTEX GENERATOR FOR FLOW CONTROL

ORIGIN OF THE INVENTION

The invention described herein was made in the performance of work under a NASA contract, and is subject to the provisions of Public Law 96-517 (35 USC 202) in which the Contractor has elected to retain title.

TECHNICAL FIELD

The invention relates to a vortex generator for fluidics flow control in general, and its application to multiphase flow applications, such as coal slurry feed flow control and/or ash outflow control in a continuous flow ash lockhopper.

BACKGROUND ART

A problem common to most coal gasification and liquefaction processes is the lack of reliable, long-life pressure-letdown valves. Such systems must accommodate gas-solid and solid-liquid-gas mixtures at temperatures up to 900° C. and pressures up to 20 MPa. Commercial development of such advanced fuel processes requires reliable, low-maintenance letdown systems. The standard approach to pressure letdown is to throttle the flow by reducing the flow area in a throated control valve. Unfortunately, high velocities in the valve throat combine with the abrasive solids content of typical coal-derived slurries resulting in excessive valve wear, lack of controllability, and short lifetimes. Attempts to use advanced materials that are more durable under such conditions have met with limited success.

A similar problem is encounted in control of a continuous flow ash lockhopper. The application (NASA NPO-16985-1-CU) titled "Energy Efficient Continuous Flow Ash Lockhopper" filed by Earl R. Collins, Jr., Jerry W. Suitor and David Dubis discloses a system shown here in FIG. 1 that employs a fluidics flow control chamber top allow ash from a lockhopper at the bottom of a coal slurry reactor to pass through under the force of gravity while preventing a flow of reactor gases to pass through with the ash by maintaining the fluid pressure in the chamber equal to or slightly higher than the internal reactor gas pressure. Consequently, for preventing the flow of reactor gases, while permitting the free gravitational flow of ash to a pressure letdown device, the control port of the chamber is designed for specified conditions, and a valve is operated to control the pressure of the control fluid (e.g., steam) into the chamber. In order for the system to operate under varying conditions, such as a varying rate of flow of ash from the lockhopper into the pressure letdown device, the chamber is provided with a pivotal D-shaped throttling sector in the inlet passage of the control fluid to allow for independent adjustment of the volume and velocity of control fluid into the chamber, which is shown to be steam from a cooling water jacket around the ash lockhopper, but may be any suitable fluid from another source.

The control chamber operates to maintain a fluidic force balance between the chamber pressure and the reactor pressure using a pressure controller which compares the reactor pressure with the chamber pressure, and adjusts the pressure of the control fluid in the chamber. The chamber is configured as a shallow disk-like chamber having an internal side wall that is kidney shaped, and a height that is significantly smaller than the transverse dimensions of the chamber. The ash exit port in the bottom of the chamber is positioned at the center of the chamber, and the ash inlet port at the top end of the chamber is offset from the exit port. The control fluid enters through the side wall and passes across the inlet port in a direction toward the side wall at the small end of the kidney shaped chamber to direct the flow of ash toward the side wall which then deflects, thereby creating a vortex that passes around and then over the exit port. While some control fluid will exit with the ash, the pressure of the control fluid in the chamber is continuously controlled to equalize, or even exceed slightly, the pressure in the reactor, and thus prevent any flow of toxic gas out of the reactor vessel.

STATEMENT OF THE INVENTION

An object of this invention is to provide a fluidics flow control chamber for multiphase flow control applications such as, for example, control of coal slurry flow into a reactor vessel and/or control of ash flow from the reactor vessel without any mechanical moving parts in the control chamber.

These and other objects and advantages are achieved in accordance with the present invention by utilizing a cylindrical chamber having a height significantly smaller than the diameter of the cylindrical chamber, an exit port centered in one planar end wall of the cylindrical chamber, and a supply port in the circular side wall of the chamber. The supply flow enters radially and, barring any control fluid flow, moves directly toward the exit port. Control fluid of relatively small volume flow and greater velocity than the supply flow is introduced into the chamber through a port tangent to the circular wall of the chamber. The control flow follows the circular wall of the chamber which deflects the supply flow to set up a vortex within the chamber. That vortex decays into a spiral pattern that eventually carries the supply flow to the exit port at the center of the chamber. The vortex of the control fluid exerts a centrifugal force against the circular wall of the chamber proportional to the square of its velocity ($v^2$). This pressure due to centrifugal force is exerted radially everywhere in the chamber against the circular wall and the inlet port in opposition to supply fluid pressure.

The control port is set about 90° ahead of the supply port to begin the control fluid vortex before encountering the supply flow. A second control port may be provided ahead of the first control port to start the vortex even earlier, which is then reenforced by the first one downstream for better control of the supply flow, but at the expense of using a larger total of control fluid flow without improvement in the ratio of control fluid pressure to the supply fluid pressure. To achieve a greater reduction in control fluid pressure, a second set of control and supply ports is provided consisting of a second supply port opposite the first, and a second control port opposite the first, thus placing each two control ports about 90° ahead of each two supply ports. This arrangement significantly reduces the ratio of control fluid pressure to supply fluid pressure. Three sets of supply and control ports could be used, oriented at 120° from each other, but improvement in the ratio of control to supply fluid pressure is small compared to the increase of the flow ratio of control fluid to supply fluid.

The novel features that are considered characteristic of this invention are set forth with particularly in the appended claims. The invention will best be understood from the following description when read in connection with the accompanying drawings.

DETAILED DESCRIPTION OF THE INVENTION

Figure 2A:
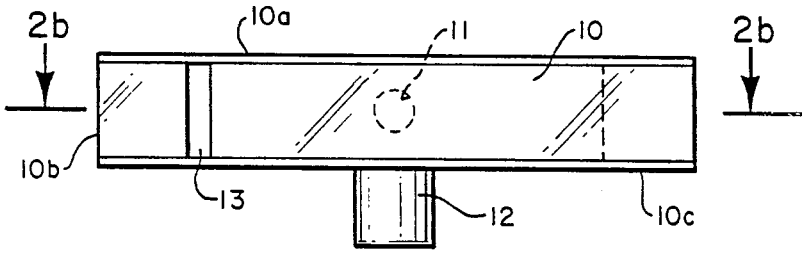
FIGS. 2*a* and 2*b* illustrate a sectional side view and a sectional plan view, respectively, of a vortex control chamber which is the subject of the present invention.

Referring to FIG. 2*a*, which discloses a cylindrical fluidic force balance control chamber 10, the supply flow from an ash lockhopper, or a coal slurry supply flow into a reactor, enters radially through a port 11 into the cylindrical chamber 10 having a circular exit port 12 at the bottom center of the chamber 10. As can be seen in FIG. 2*a*. The fluidics control chamber 10 may be assembled from three plates 10*a*, 10*b* and 10*c* shown in FIG. 2*a*. The top plate 10*a* is a flat cover for one side of the plate 10*b* machined in the configuration shown in FIG. 2*b*, which is a sectional view taken on a line 2*b*–2*b* in FIG. 2*a*. The principal part machined in the plate 2*b* is the chamber itself. The height of the chamber is equal to the thickness of the plate 10*b*. It is also machined to form the radical and tangential ports 11 and 13. A flat plate 10*c* with the exit port 12 in the middle closes the fluidics control chamber 10 at the other end. Barring any means for control, an uncontrolled flow of ash entering radially through the supply inlet port 11 travels directly to the exit port 12.

Control fluid enters the chamber 10 through the tangential port 13 to allow a control flow of a relatively small volume of fluid to enter (at a greater velocity than ash entering the chamber) and set up a circular flow pattern contained by the cylindrical wall of the chamber. The flow of combined control fluid and ash gradually moves away from the cylindical wall in a spiral path, and finally exits through the port 12. The vortex of control fluid exerts a pressure against the wall proportional to its velocity squared, and inversely proportional to the radius of the chamber. This pressure due to centrifugal force acts everywhere radially outward, against both the cylinder wall and the supply port in opposition to gas pressure in the reactor. Thus, the greater the control fluid pressure and flow, the smaller the flow of gas from the supply inlet port, and at a point where the force due to the pressure resulting from the centrifugal force plus the pressure in the control chamber, exactly equals the gas pressure in the reactor, there is no gas flow from the reactor. That point is termed the cutoff point. The only fluid that flows out of the control chamber is the control fluid, but the solid ash particles continues to flow down through the control chamber under the force of gravity.

Figure 1:
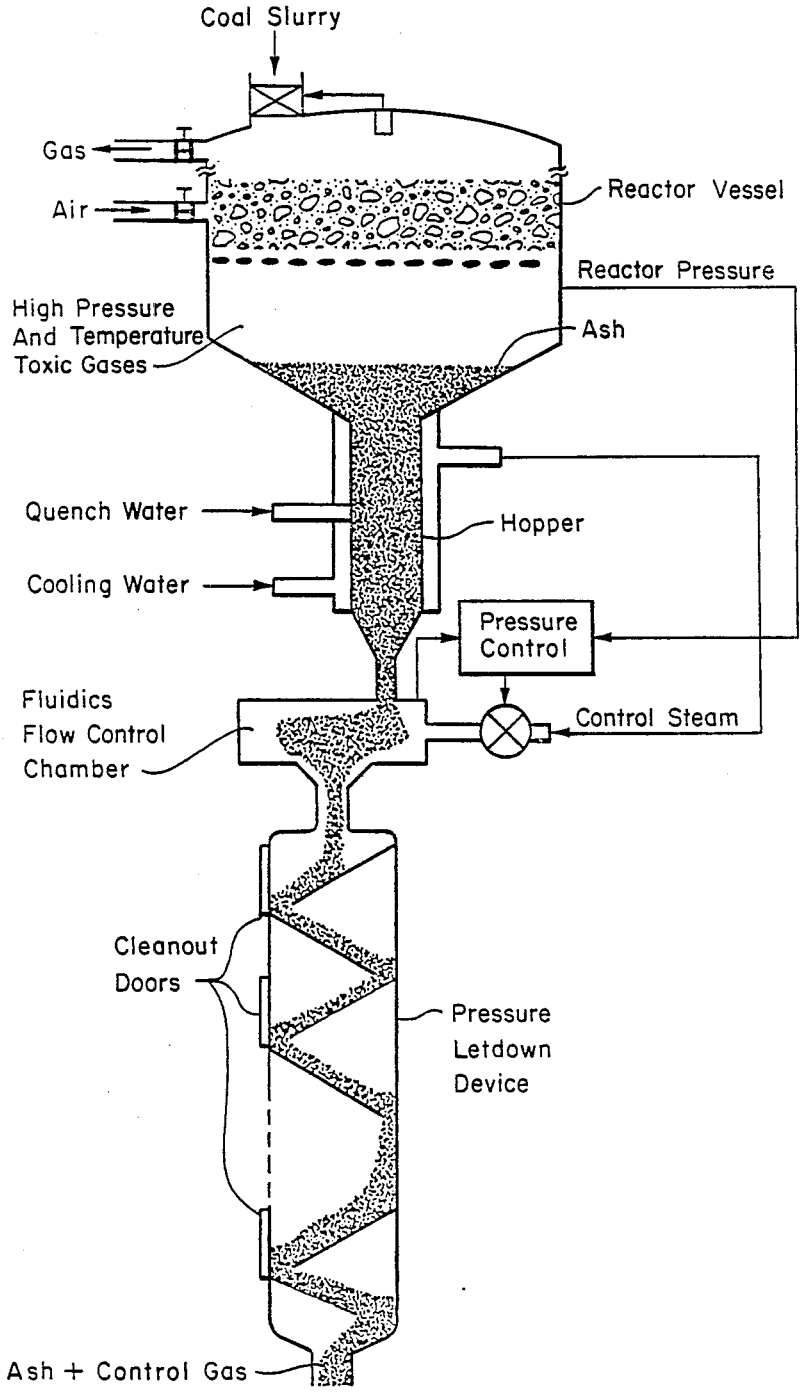
(Prior Art) FIG. 1
FIG. 1 illustrates shcematically the prior-art continuous flow lockhopper with a fluidics control chamber in accordance with the copending application cited hereinbefore.
Figure 2B:
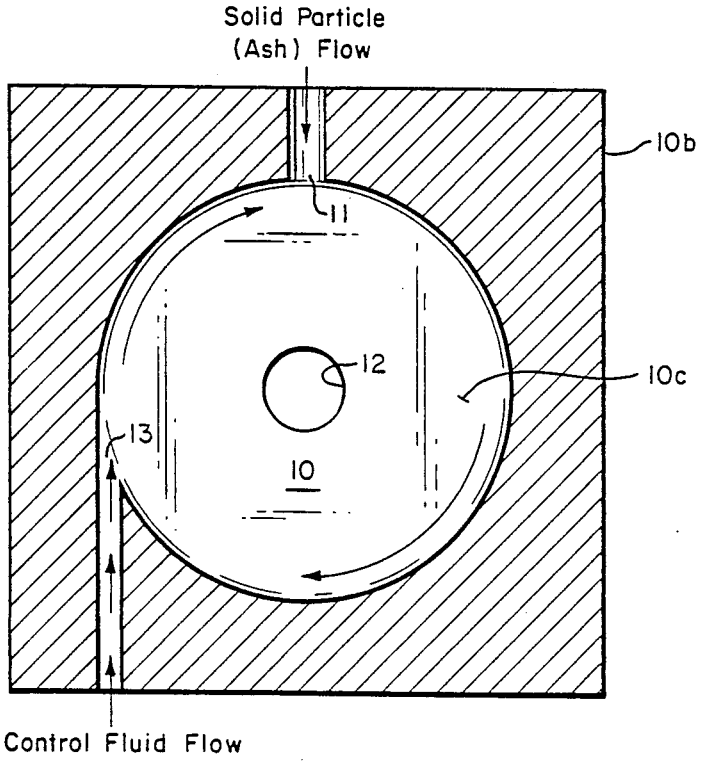

Using this device in the continuous flow ash lockhopper, with the control port located 90° ahead of the supply port, as shown in FIG. 2*b*, it was found that complete cutoff of the reactor gas could be attained. However, the fluidics control chamber for the ash lockhopper application, i.e., for the control of ash flow into the pressure letdown device shown in FIG. 1, a fluidics control chamber shown in FIG. 4 is preferred in order to lower flow velocity, and therefore reduce erosion caused by the ash flow.

Figure 3:
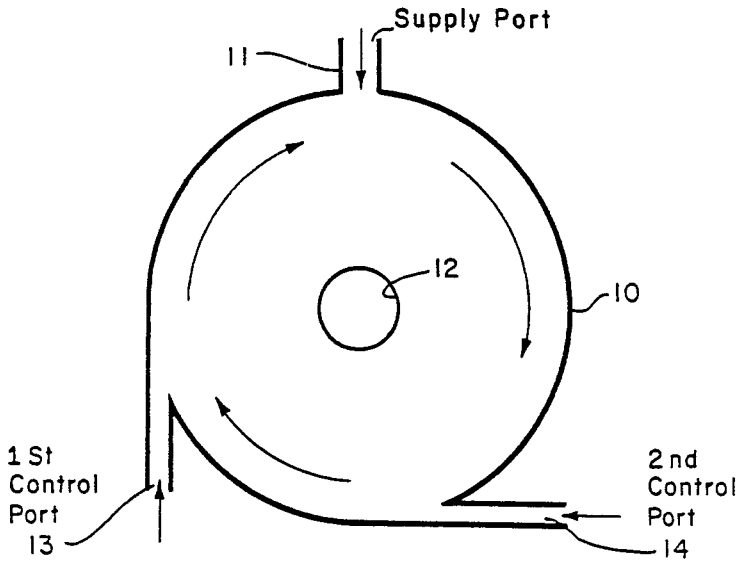
FIG. 3 illustrates schematically a plan view of a second embodiment of a control chamber similar to that shown in FIGS. 2*a* and 2*b*.

In order to improve the turndown ratio, obtain better control, and reduce the control pressure needed at cutoff, the control port was moved next to the supply port, where it could impinge directly on the supply stream at right angles. This resulted in a degradation of control; it is believed that this destroyed the vortex and resulted only in turbulent flow mixing the control flow with the supply flow. By adding a second control port 14 90° ahead of the orginal vortex generator port 13, i.e., by adding a control port diametrically opposite the supply port, as shown in FIG. 3, better control resolution of the supply flow was sought. The intent was that the second control port would start the vortex motion of the control fluid, which then would be reinforced by the control flow from the original port 13, thus opposing reactor gas in the supply flow more positively, and obtaining better control. This approach did yield better control resolution, but exhibited a significant degradation in the turndown ratio—more control fluid was required than before. In addition, there was no improvement in the control pressure needed to ensure reactor gas flow cutoff. It is believed that the second control port 14 merely lowered the entrance velocity of the control fluid stream vis-à-vis that of the supply stream; and the latter was not being sufficiently diverted to flow along the chamber wall.

Figure 4:
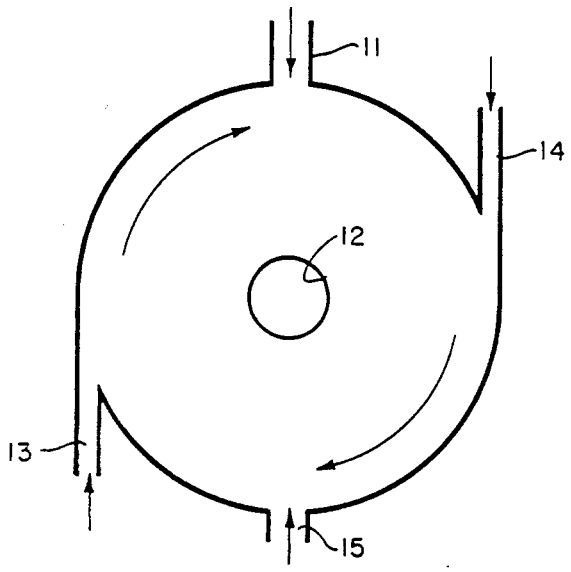
FIG. 4 illustrates schematically a preferred variation of the embodiment of FIG. 3.

The solution to providing optimum control in the chamber is to add a second supply port 15 as long with the second control port 14, as shown in FIG. 4, i.e., to have two sets of ports with the control port of each set ahead of the supply port by about 90° so as to halve the velocity of the supply stream while retaining the leading angle of the original port 13 and obtaining symmetry. It is expected that a reduction in cutoff pressure ratio could be achieved by adding yet another set of ports disposed 120° apart, particularly for coal slurry supply control, but the improvement could only be minor for in no case can the control fluid pressure at cutoff drop below the coal slurry supply pressure. With the configuration of FIG. 4, control pressure is only 25% higher than coal slurry supply pressure. In considering the original configuration where control fluid pressure in the chamber exceeded coal slurry supply by 450%, it can be fairly concluded that all possible substantial gains in this ratio have been made by the configuration of FIG. 4.

Figure 5:
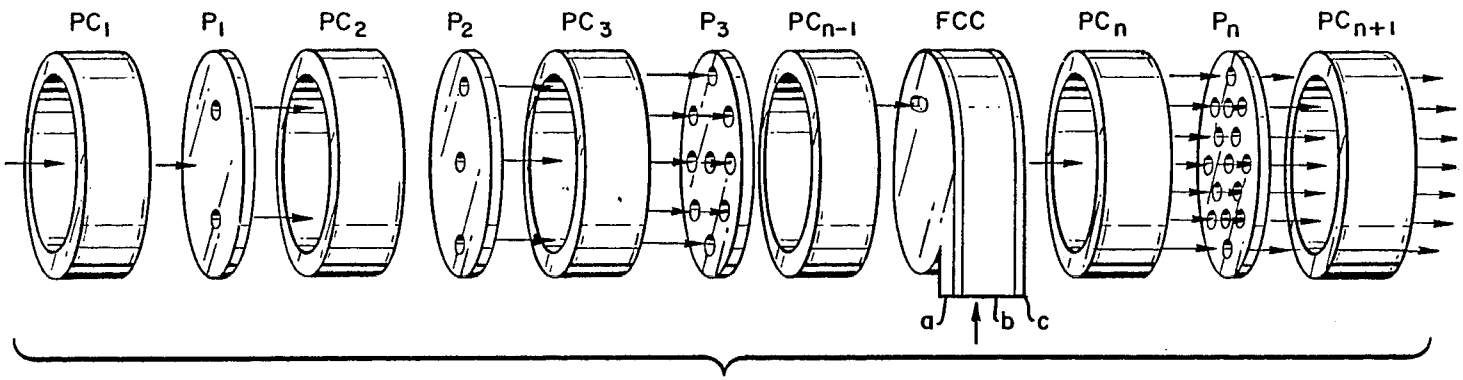
FIG. 5 illustrates a pressure letdown device with a fluidics flow control chamber of the present invention comprised of perforated plates separated by plenum chambers, with one plenum chamber replaced by the fluidic flow control chamber for control of supply flow rate.

For use of the fluidics flow control chamber shown in FIGS. 2 through 4 as a coal slurry letdown valve at the top of the reactor shown in FIG. 1, a "porous plug" arrangement shown in FIG. 5 is employed. In that arrangement, coal slurry supply pressure is reduced through a series of successive flat plates $P_1$, $P_2$, ... $P_n$ while maintaining low velocities through each of the plates. The "porous plug" principle is based on isenthalpic pressure drop through a plug composed of very small passages, which are not possible in a coal slurry application due to the size of the coal particles and the plugging potential of the larger particles. Therefore a quasi porous plug was conceived to overcome the problem by J. Kendall as disclosed in U.S. Pat. No. 4,418,722.

The pressure letdown device in that patent is comprised of conical plates with apertures of uniform size increasing in number, and therefore increasing in total area, as flow progresses downstream. In this invention, the pressure letdown device is comprised of a number of stages, with each stage consisting of a plenum chamber and a perforated plate. The plates are flat, as shown in FIG. 5, and are positioned between plenum chambers $PC_1$, $PC_2$ ... $PC_n$ comprised of hollow cylindrical sections. The number and size of apertures are chosen to provide a total flow area large enough to pass entrained particles and maintain a low velocity in order to reduce erosion caused by the abrasive solid particles.

A process stream containing a flashing component will have increased volumetric flow rate during pressure letdown due to the vapor generated by the drop in pressure at constant or near constant temperature. The aperture areas in the perforated plates are increased in progression to maintain a constant velocity through the preforated plates, i.e., to accomodate the volumetric flow rate. Control of the flow is accomplished by a fluidics control chamber FCC between stages, such as in place of a plate between plenum chambers $PC_{n-1}$ and $PC_n$ for enough downstream in the pressure letdown device to be subject to low velocity flow, as shown in FIG. 5.

Figure 6:
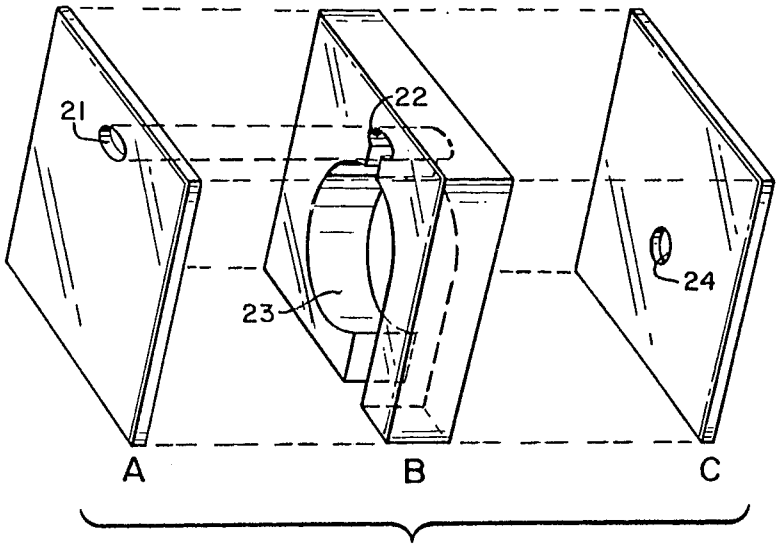
FIG. 6 illustrates in an exploded isometric view one example of a fluidic flow control chamber for the pressure letdown device of FIG. 5.

The fluidics control chamber for this application may be fabricated using three plates a, b and c machined in the configurations of plates A, B and C shown in FIG. 6, for example, with one set of ports as shown in FIGS. 2*a* and 2*b* for simplicity of illustration, but preferably with two sets of ports as shown in FIG. 4. The lefthand end plate A is made of a thin metal sheet with an aperture 21 situated to feed into an aperture 22 in a thicker metal plate B having a control chamber 23 machined through it along with a channel for the supply flow from the aperture 22 into the chamber 23, and a channel for the control flow into the chamber. A thin metal plate C with a port 24 is placed on the right of the chamber 23 to close it, except for the exit port 24 at the center of the chamber 23. A plenum chamber $PC_n$ permits the exit flow to disperse to all of the apertures in the following plate $P_n$.

The fluidics control chamber designed in accordance with the schematic diagram of FIG. 4 is preferred because a smaller control flow rate (brought forward from the main control supply line, or an auxiliary control flow line) can modulate the slurry flow. As noted hereinbefore, that is done by producing a vortex induced spiral flow in the control chamber. The spiral increases the centrifugal force and adds flow resistance to the supply stream, thereby reducing supply flow rate. The control fluid enters the control port and, by providing pressure and centrifugal forces against the entering supply flow, regulates the supply flow rate through the flow control chamber. The effectiveness of flow control may be quantified through the turndown ratio, TR defined as:

$$TR = \frac{\text{Uncontrolled Supply Flowrate}}{\text{Controlled Supply Flowrate} + \text{Control Fluid Flowrate}}$$

Cutoff of the supply flow is achieved when the supply flowrate is reduced to zero.

Tests have confirmed that control of pure liquid flow could be achieved with the design of FIG. 2, but only with a very high control-to-supply flow-pressure ratio, $P_c/P_s$. To overcome the problem, the design of FIG. 4 was developed with two supply and two control ports. Later tests with the design of FIG. 4 using water showed considerably improved performance. When this solution was tried, it was found that there was a significant improvement in turndown ratio, but a large unexpected improvement in cutoff pressure ratio. Using water as a control fluid for the experiment, it now took only 100 psig control fluid pressure to cut reactor gas flow off with 80 psia reactor gas pressure; a cutoff pressure ratio of 1.25:1, representing an improvement of 440%. The design of FIG. 4 was then subjected to a much more severe test in a 20-stage pressure letdown device of the type shown in FIG. 5 using a slurry consisting of 75% No. 2 diesel fuel, 22% pulverized (220 mesh) coal, and 3% n-Pentane, by weight. The results proved quite successful in that cutoff of the supply flow at 1.38 MPa was achieved with $P_c/P_s=1.25$ and $TR=3.09$.

Figure 7:
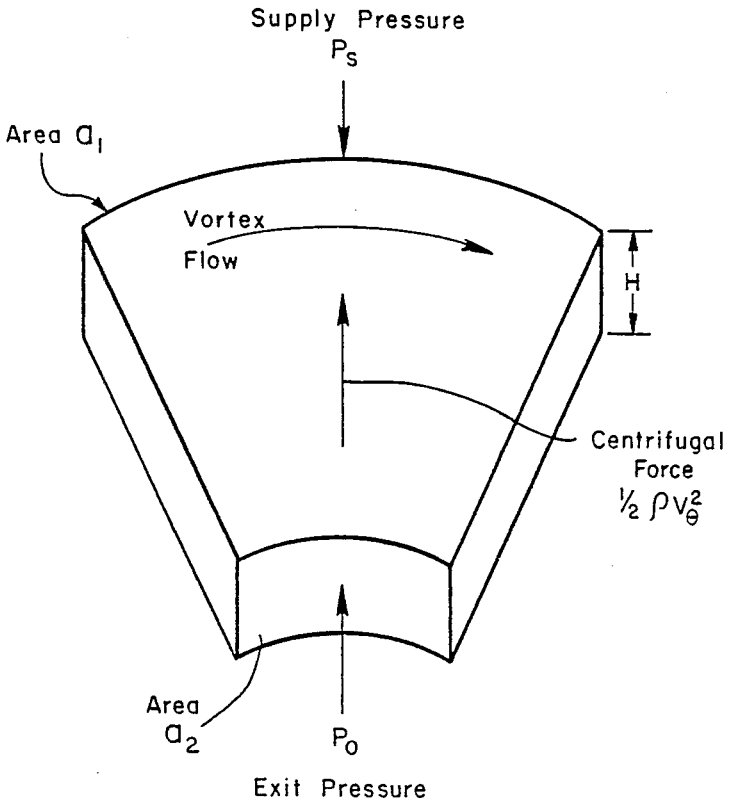
FIG. 7 illustrates schematically the force balance of the fluidics control chamber of the present invention.

The force balance of the fluidics control chamber of the present invention is illustrated schematically in FIG. 7 by a segment of the chamber between the exit port, at which the exit pressure is Po, and the chamber wall at the supply port, at which the supply pressure is $P_s$. The control flow vortex created in the chamber moves along the chamber wall at a tangential velocity $V_o$ and produces a centrifugal force against the wall, and therefore the supply flow port as well is equal to $\frac{1}{2}\rho V_o^2$, where $\rho$ is the density of the control fluid. At zero supply flow, the supply pressure is balanced by the centrifugal force and exit pressure, as given by the following equation:

$$A_1P_s - A_2P_o - 0.5\rho V_\theta^2(\pi DH) = 0$$

where $A_1$ is the area over which the supply pressure $P_s$ is applied, $A_2$ is the area over which the exit pressure $P_o$ is applied, D is the control element diameter and H is the height of the control element chamber.

In tests for the balanced condition using water for both the supply and the control fluid, the ratio of the control fluid pressure $P_c$ to the supply fluid pressure $P_o$ was found to be 4.4 and 4.8 for the two-port and three-port configurations of FIGS. 2 and 3, and only 1.21 for the four-port configuration. With diesel No. 2 as the supply and control fluid, the ratio $P_c$:$P_s$ was found to be 1.8, which is still a very good ratio in considering flow control of the coal slurry referred to hereinbefore with diesel No. 2 as the control fluid.

The turndown ratio, which is the ratio of output flow with a letdown device and no contol to output flow with control, i.e., the ratio of uncontrolled supply flowrate to the sum of controlled supply flowrate and control fluid flowrate, all with a letdown device is given by the following table for the two-part, three-port and four-port configurations of FIGS. 2, 3 and 4 by the following:

| Ports | $P_s$ (psia) | $P_c$ (psia) | Supply and Control Fluid | Turndown Ratio |
|---|---|---|---|---|
| 2 | 95 | 15 | Water | 1.0 |
| | 95 | 165 | | 1.19 |
| | 95 | 415 | | 2.11 |
| 3 | 95 | 15 | Water | 1.0 |
| | 95 | 195 | | 1.5 |
| | 95 | 455 | | 3.33 |
| 4 | 95 | 15 | Water | 1.0 |
| | 95 | 115 | | 2.73 |
| 4 | 95 | 15 | Diesel No. 2 | 1.0 |
| | 95 | 170 | | 2.4 |

From the table above, it is clear that the four-port configuration of FIG. 4 for the fluidics flow control chamber with a letdown device provides better performance in the turndown ratio over the two-port configuration of FIG. 2 by a factor of better than 2, while the three-port configuration of FIG. 3 shows some improvement by a factor of about 1.25 to 1.58, with the improvement increasing from the factor of 1.25 to 1.58 as the control fluid pressure increases to 455 psia. Thus, from the point of view of the ratio of control fluid pressure to supply fluid pressure at cut off, and the turndown ratio, the four-port configuration of FIG. 4 is to be preferred.

Although particular embodiments of the invention have been described and illustrated herein, it is recognized that modifications and variations may readily occur to those skilled in the art. Consequently, it is intended that the claims be interpreted to cover such modifications and variations.

We claim:

1. A fluidics flow control chamber having a cylinder configuration with a height between parallel ends smaller than the diameter of said cylindrical chamber, an exit port at the center of one of said ends of said cylindrical chamber, at least one supply inlet port in the circular side wall of said cylindrical chamber for directing supply flow into said chamber in a radial direction toward said exit port, and at least one tangential control fluid port in the circular side wall of said cylindrical chamber for admitting a control fluid into said chamber along a vector tangent to said circular side wall upstream from said supply inlet port at a point in said circular side wall ahead of said supply inlet port, whereby said circular side wall deflects said control fluid in a circular path across said inlet before control fluid reaches said supply inlet port to create a centrifugal force against said supply flow in said inlet port to intiate a vortex in said supply flow which causes said supply flow to follow a spiral path to said exit port of said chamber for allowing the flow rate of said supply flow through said chamber while said control fluid pressure into said chamber is regulated for flow rate control.

2. A fluidics flow control chamber as defined in claim 1 wherein said tangential control fluid port is about 90° upstream from said inlet port.

3. A fluidics flow control chamber as defined in claim 1 wherein said chamber includes a second control fluid port upstream from said one tangential control fluid port.

4. A fluidics flow control chamber as defined in claim 3 wherein said chamber includes a second supply inlet port for directing supply flow into said chamber in a radial direction toward said exit port, said second supply inlet port and said second tangential control fluid port being spaced in said circular wall of said chamber as a second set of ports symmetrical to said one supply inlet port and one tangential control fluid port.

5. A fluidics flow control chamber as defined in claim 4 wherein said supply inlet ports are diametrically opposite to each other and said tangential control fluid ports are diametrically opposite to each other.

6. A fluidics flow control chamber comprised of a cylindrical chamber having a circular wall and two parallel planar end walls, said chamber having a small height between said end walls relative to the diameter of said chamber, and at least one supply inlet port into said chamber through said circular wall of said chamber, said supply inlet port having its axis intersect the center of said cylindrical chamber for supply flow in an initial direction toward the center of said chamber, an exit port in the center of one of said end walls, at least one control fluid inlet port through said circular wall, said control fluid inlet port having its axis tangent to said circular wall of said cylindrical chamber, said control fluid inlet port being of uniform width from one planar end wall to the other planar end wall of said chamber, said control fluid inlet port being oriented for initial flow into said chamber in a direction tangent to said circular wall and parallel to the axis of said supply port.

7. A fluidics flow control chamber as defined in claim 6 having at least a second control fluid inlet port of uniform dimension from one end wall to the other end wall of said chamber, said second control fluid inlet port being oriented for initial flow into said chamber in a direction tangent to said circular wall and perpendicular to the axis of said one control fluid inlet port.

8. A fluidics flow control chamber as defined in claim 6 having at least a second control fluid inlet port of uniform dimension from one planar end wall to the other planar end wall of said chamber, said second control fluid inlet port being oriented for initial flow into said chamber in a direction tangent to said circular wall and parallel to the axis of said one control fluid inlet port, and a second supply inlet port diametrically opposite side one supply inlet port also oriented for supply to flow into said chamber in an initial direction toward said exit port.

* * * * *